US005249791A

United States Patent [19]

Belanger et al.

[11] Patent Number: 5,249,791

[45] Date of Patent: Oct. 5, 1993

[54] ARRANGEMENT FOR BRAKING PRINTED PRODUCTS IN A FAN DELIVERY OF A FOLDER

[75] Inventors: Roger R. Belanger, Dover, N.H.; Gilles L. Fecteau, Saco, Me.; Richard B. Mack, Heidelberg, Fed. Rep. of Germany

[73] Assignee: Heidelberg Harris GmbH, Heidelberg, Fed. Rep. of Germany

[21] Appl. No.: 900,837

[22] Filed: Jun. 18, 1992

[51] Int. Cl.[5] ..... B65H 29/68

[52] U.S. Cl. ..... 271/182; 271/187; 271/315

[58] Field of Search ..... 271/182, 187, 315

[56] References Cited

U.S. PATENT DOCUMENTS

| | | | |
|---|---|---|---|
| 3,685,823 | 8/1972 | Chambon | 271/182 |
| 4,522,387 | 6/1985 | Leuthold | 271/315 |
| 4,600,186 | 7/1986 | von Hein et al. . | |
| 5,083,768 | 1/1992 | Ertavi et al. | 271/315 |
| 5,114,135 | 5/1992 | Evangelista et al. | 271/315 |
| 5,131,646 | 7/1992 | Balow | 271/315 |

FOREIGN PATENT DOCUMENTS

| | | | |
|---|---|---|---|
| 3910333 | 3/1990 | Fed. Rep. of Germany . | |
| 69448 | 3/1989 | Japan | 271/315 |

*Primary Examiner*—Robert P. Olszewski
*Assistant Examiner*—Steven M. Reiss
*Attorney, Agent, or Firm*—Herbert L. Lerner; Laurence A. Greenberg

[57] ABSTRACT

In a fan delivery unit of a folder having a plurality of fan discs arranged next to one another on a motor shaft, the fan discs being formed with a plurality of fan blades having fan pockets therebetween, there is provided a device for braking printed products. The braking device includes a driven brake shaft disposed parallel to the motor shaft, a plurality of brake rollers corresponding in number to the number of fan discs being mounted on the brake shaft, and a device for driving the brake shaft via the motor shaft selectively in one of two rotational directions. The brake rollers and leading edges of the fan blades are cooperative for delaying travel of a printed product introduced into the respective fan pockets.

11 Claims, 6 Drawing Sheets 1
2
2a
2b
2c
3
4
5
6
7
8
9
10
11
12
13
14
15
16
17
18
19
21
26
34

Figure 1:
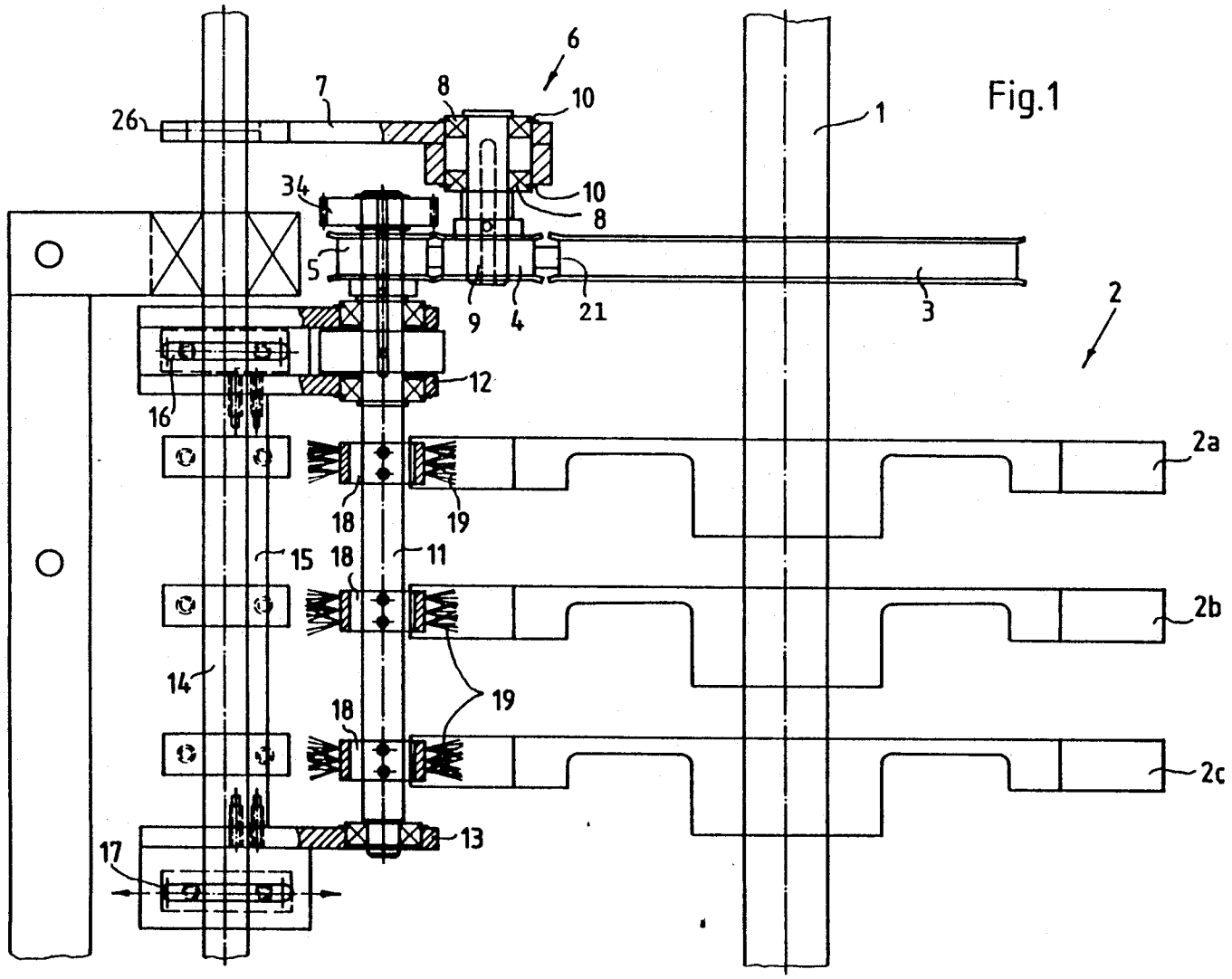

0 degrees 4 deg.

23
24
2
23
19a
11
18
4
20c
12
19b
34
A
3
35
20b
29
14
5a
33
20a
1
20
21
22
30
10 deg.

23
24
2
23
19a
11
18
4
34
12
19b
20c
3
A
29
14
5a
33
20b
20a
1
20
22
21
30
30 deg.

ARRANGEMENT FOR BRAKING PRINTED PRODUCTS IN A FAN DELIVERY OF A FOLDER

The invention relates to an arrangement for slowing-down or braking printed products or signatures in the fan delivery of a folder.

From German Patent 39 10 333, a device has become known heretofore for reducing the impact speed of printed products. Rotating cam discs arranged beyond or outside the envelope curve of a delivery fan cooperate with rollers which are driven like the cam discs. Folded products, also known as signatures and books, entering into respective pockets formed in the delivery fan are briefly held at the trailing end of the pockets due to the cooperation of the cam discs and rollers, are released again and, then, reach the bottom of the respective fan pockets. U.S. Pat. No. 4,600,186 discloses a rotating cam disc arranged within the envelope curve of a fan and provided with three cams. When the trailing ends of the printed products are gripped, the cams likewise cooperate with rotating rings. A common characteristic of both of the heretofore known devices of the aforementioned patents is the occurrence of an abrupt jerking start-up of the braking process when the trailing ends of the printed products are gripped. Especially in the case of printed products which are rather thick, this may cause problems. Inherent to both of the heretofore known devices is an extensive drive of rollers and rings, respectively, cooperating with the cam discs and being, in addition, difficult to adjust.

It is accordingly an object of the invention to provide a device for slowing-down or braking printed products wherein a considerable delay of the printed products is achieved.

With the foregoing and other objects in view, there is provided, in accordance with the invention, in a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on the brake shaft and corresponding in number to the number of the fan discs, and means for driving the brake shaft via the motor shaft selectively in one of two rotational directions, the brake rollers and leading edges of the fan blades being cooperative for delaying travel of a printed product introduced into the respective fan pockets.

Advantages of the foregoing arrangement according to the invention, are that, in a device for braking or slowing-down printed products, the number of fan pockets in the fan can be increased without having to take into account any loss in brake efficiency. This affords a higher productivity. Furthermore, abrupt braking or slow-down of the printed products has been eliminated at the trailing end thereof; the mechanical stressing of the printed products is lower. Also, the danger of ink smearing in the braking region at the trailing end of the printed product is decreased. Furthermore, additionally drivable brake elements, such as rings or rollers, can be dispensed with, because the common movement of the leading edge of the fan blades and the circumferential surfaces of the brake rollers are utilized for braking, and a harmonically proceeding delay or slow-down is achievable.

In accordance with another feature of the invention, there are provided brush segments disposed opposite one another on and fastened to the brake rollers. In an advantageous manner, a gradual increase in brake force or power during rotation is achieved thereby. By suitably arranging the brush segments on the peripheral surface of the brake rollers, a reliably controlled braking or slow-down of each individual printed product introduced into a fan pocket can be achieved.

In accordance with a further feature of the invention, there are provided at least one ring mountable on the brake shaft, and elastic coverings applied around the circumference of the one ring, the elastic coverings being disposed opposite one another and having a varying thickness in circumferential direction.

In accordance with an alternate feature of the invention, there are provided at least one ring mountable on the brake shaft, and elastic coverings applied to the one ring, the elastic coverings having a friction value variable over the respective length thereof.

These possible constructions of the arrangement according to the invention offer the advantage of ensuring a gradually actuatable, controlled braking or slow-down of the printed product, due to which mechanical stressing of the printed products is considerably reduced. The fan geometry and the thickness geometry of the covering are coordinated with one another in such a manner that minimal relative velocities occur.

In accordance with an added feature of the invention, there are provided an axial beam disposed adjacent the driven brake shaft, and means for displaceably mounting shaft bearings for supporting the brake shaft on the axial beam, the means being formed with slots for guiding the displaceable shaft bearings. This offers the possibility of individually adjusting the amount of brake force or power which is applied.

In accordance with an additional feature of the invention, there are provided shaft bearings supporting the driven brake shaft and a further shaft located adjacent thereto, the brake shaft and the further shaft having a respective belt pulley and a respective gear wheel carried on respective drive-side ends thereof. Various possible drives are thereby derivable therefrom.

In accordance with yet another feature of the invention, the means for driving the brake shaft comprise a first belt pulley mounted on the motor shaft, a second belt pulley mounted on the brake shaft, and a drive belt looped about the first and the second belt pulleys for directly driving the brake shaft in a direction of rotation opposite that of the motor shaft. This construction affords a drive for the brake shaft, wherein directions of movement of the brake rollers and of the leading edges of the fan blades run in opposite direction from one another.

In accordance with an alternate feature of the invention, the means for driving the brake shaft comprise a belt pulley mounted on the motor shaft, and there are included a further shaft disposed adjacent the brake shaft, respective meshing gears mounted on the brake shaft and the further shaft, a pulley mounted on the further shaft, and a drive belt looped about the pulley mounted on the motor shaft and the pulley mounted on the further shaft for driving the brake shaft in the same direction of rotation as that of the motor shaft. A possible drive is thus provided wherein the brake rollers and the leading edges of the fan blades of the fan discs move together in the same direction during the slow-down or braking.

In accordance with yet a further feature of the invention, the means for driving the brake shaft include a belt tightening roller engaging the drive belt for tightening the belt.

In accordance with a concomitant feature of the invention, the means for driving the brake shaft comprise a first belt pulley mounted on the motor shaft, a second belt pulley mounted on the brake shaft, a further shaft disposed adjacent the brake shaft and having a third belt pulley mounted thereon, respective intermeshing gears mounted on the brake shaft and on the further shaft, and a drive belt alternately loopable about one of the second and the third belt pulleys, respectively, and the first belt pulley, for driving the brake shaft in rotational directions, respectively, opposite to and the same as that of the motor shaft.

Other features which are considered as characteristic for the invention are set forth in the appended claims.

Although the invention is illustrated and described herein as embodied in an arrangement for braking printed products in a fan delivery of a folder, it is nevertheless not intended to be limited to the details shown, since various modifications and structural changes may be made therein without departing from the spirit of the invention and within the scope and range of equivalents of the claims.

Figure 1A:
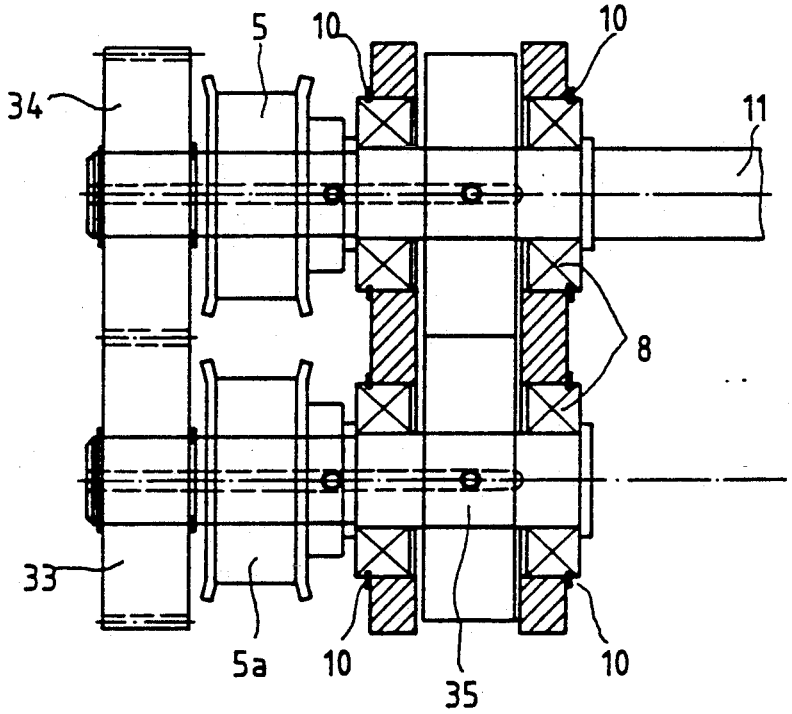
Figure 2:
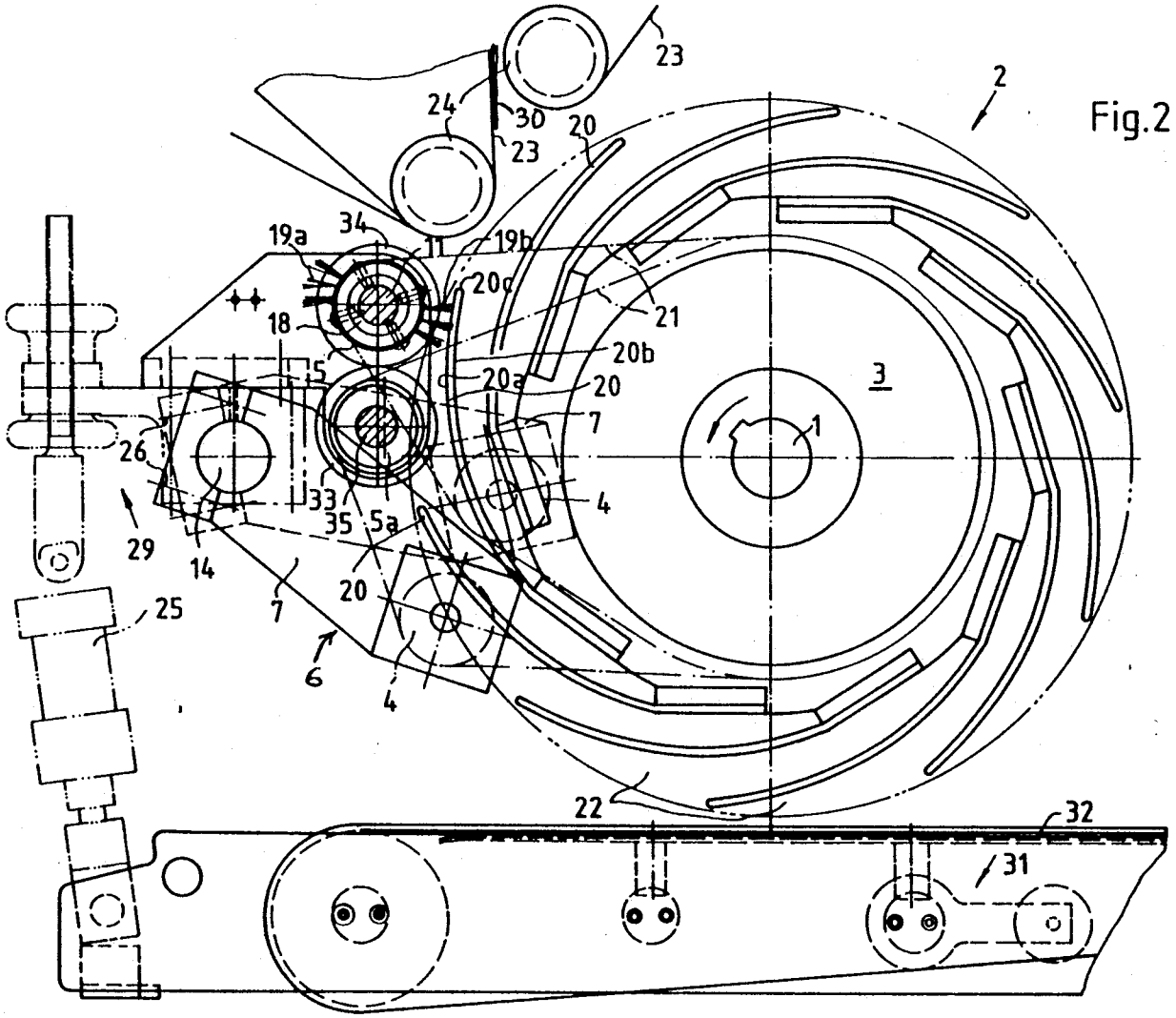
Figure 3A:
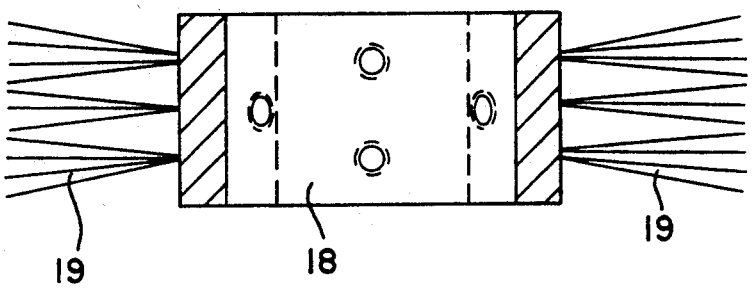
Figure 3B:
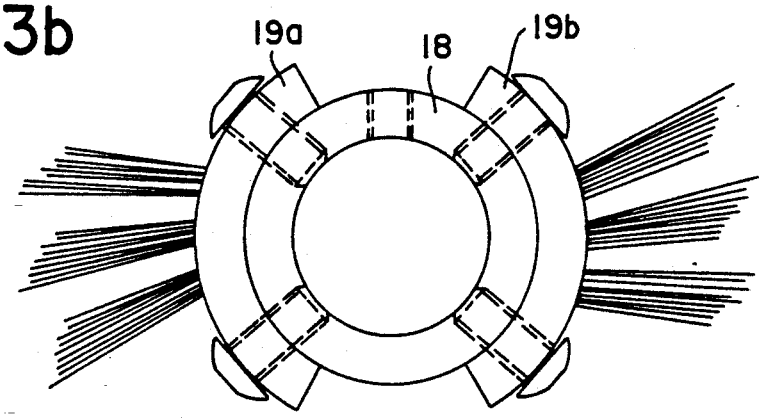

The construction and method of operation of the invention, however, together with additional objects and advantages thereof will be best understood from the following description of specific embodiments when read in connection with the accompanying drawings, in which:

FIG. 1 is a diagrammatic plan view, partly in section, of fan discs, a brake shaft and a belt drive forming part of the arrangement for slowing-down or braking printed products in a fan delivery of a folder constructed in accordance with the invention;

FIG. 1*a* is an enlarged fragmentary plan view of FIG. 1 showing the brake drive in greater detail;

FIG. 2 is a side elevational view of FIG. 1 showing the fan delivery with delivery transport tapes associated therewith;

FIG. 3*a* is an enlarged fragmentary cross-sectional view of FIG. 1 showing a brake covering of a brake roller thereof;

FIG. 3*b* is a plan view of FIG. 3*a;*

Figure 3C:
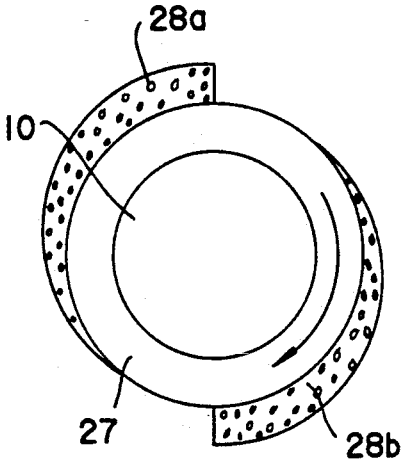
Figure 4A:
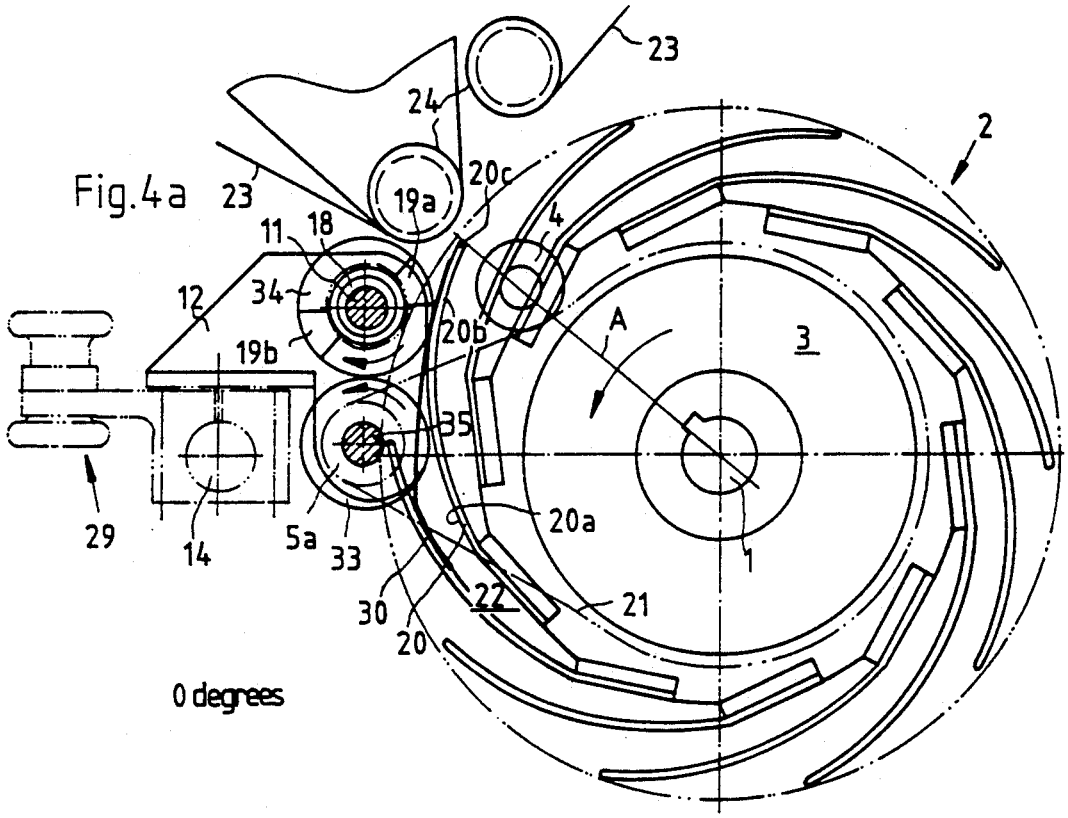

FIG. 3*c* is a diagrammatic plan view of another embodiment of the brake covering of a brake roller;

FIGS. 4*a, b, c, d* are side elevational views of FIG. 1, showing the various components of the arrangement in different phases of operation thereof.

Referring now to the drawing and, first, particularly to FIG. 1 thereof, there is shown therein in a plan view, fan discs, brake rollers and a belt drive forming components of the arrangement for slowing-down or braking printed products in a fan delivery of a folder, in accordance with the invention.

On a motor shaft 1, the specific location of which need not be further elaborated on herein, a fan arrangement 2 formed of several fan discs 2*a*, 2*b* and 2*c* is positioned. A belt pulley 3 is, furthermore, provided on the motor shaft 1, for driving a brake shaft 11. A drive belt 21 (shown in phantom in FIGS. 4*a* to *d*) which revolves around the belt pulley 3 and another belt pulley 5, is stretched by a belt tightening roller 4 mounted on a belt tensioner 6. The belt pulley 5 is mounted on a brake shaft 11 which is journaled in two shaft bearings 12 and 13. The shaft bearing 12 has a double ball bearing for an end of the brake shaft 11 at the drive side thereof, while the other end of the brake shaft 11 is journaled in a single ball bearing in the shaft bearing 13.

The brake shaft 11 can rotate at a 5:1 ratio with respect to the motor shaft 1. Assurance is thereby afforded that brake rollers 18 carrying brush segments 19*a* and 19*b* (note FIG. 3*b*, especially), act upon or snub respective trailing edges 20*b* of every printed product 30 which is introduced into one of ten fan pockets 22, for example (note FIGS. 2 and 4*a* to *d*). It is also conceivable to drive the brake shaft 11 independently of the motor shaft 1 by means of a separate driving source connected to the brake shaft 11. In such a case, synchronization of the driving source and the motor shaft 1 must be provided.

The belt tensioner 6 is mounted on an axial beam 14 also adjacent the shaft bearings 12 and 13. The belt tensioner 6 has a tension lever 7 which carries two ball bearings 8 wherein a short shaft 9 is mounted which supports the belt tightening roller 4.

The shaft bearings 12 and 13 which are mounted on the axial beam 14 are shiftable in a direction towards, as well as away from the fan discs 2*a*, 2*b* and 2*c* in elongated holes or slots 16 and 17 formed, for example, in respective supporting brackets. Both of the shaft bearings 12 and 13 are connected to one another by a tie-bar or traverse 15, which is doubly screwed to each of the respective shaft bearings 12 and 13.

Several brake rollers 18, respectively assigned to each of the fan discs 2*a*, 2*b* and 2*c*, are mounted on the brake shaft.

In the embodiment of the arrangement illustrated in FIG. 1, the brake rollers 18 have brushes 19 disposed on the outer peripheral surfaces thereof.

As is apparent from FIG. 1*a*, a belt pulley 5 and a gear wheel 34 are mounted on the brake shaft 11. Also located on a further shaft 35 is a belt pulley 5*a* and a gear wheel 33; various drive possibilities are thereby offered with regard to the direction of rotation of the brake rollers 18 (note FIG. 2).

FIG. 2 is a side elevational view of a fan delivery unit with a delivery transport tape associated therewith. A fan arrangement 2 having several fan discs 2*a*, 2*b* and 2*c* (FIG. 1) is fastened on the motor shaft 1. The fan discs are, respectively, formed with fan blades 20 which, depending upon the direction of rotation of the fan discs, have respective leading edges 20*a* and respective trailing edges 20*b*. Defined between pairs of the individual fan blades 20 are fan pockets, which are ten in number in the illustrated embodiment. The printed products 30 to be conveyed by the fan arrangement 2 are guided into the fan pockets 22 of the fan arrangement 2 by conveyor belts 23, which revolve on idler rollers 24. The feed of the printed products 30 is timed so that a printed product 30 released from the conveyor belts 23 is introduced into a fan pocket 22 when the printed product is located opposite the release-opening between the individual conveyor belts 23. After the leading edge of the printed product has entered the respective fan pocket 22, the printed product slides along the leading edge 20*a* of the respective fan blade 20 partly defining the fan pocket 22 in a direction towards the bottom of the fan pocket 22.

Due to the rotation of the fan discs 2*a*, 2*b* and 2*c* towards the brake rollers 18, the trailing portion of the printed product 30 is located adjacent to the upper region of the trailing edge 20*b* of the adjacent fan blade 20 further defining the fan pocket 22. The brake roller 18 is provided with two brush segments 19*a* and 19*b* which revolve in the direction of the associated arrow shown in FIG. 4*a*. Accordingly, in the embodiment shown in FIG. 2, the brush segment 19*b* approaches the leading edge 20*a* and engages thereat a trailing end of a printed product 30 adjacent thereto. Due to the fact that elastic brush segments are employed, a build-up of brake force or power takes place successively up to a maximum value at which bristles of the brush segments 19*a* and 19*b* become sharply bent. On the other hand, the end of the fan blade 20*c* moves towards the brush segment 19*b*, along the envelope curve of the fan disc, as shown in FIG. 2, and thereby increases the braking effect. Because the leading edge 20*a* as well as the brush segment 19*b* is revolving, the braking or slowing-down of the respective printed product is effected by parts moving relative to one another. Printed products which are braked in this manner impact, after braking, with the bottom of the fan pockets 22 without becoming damaged. Furthermore, two possible types of drives for the brake shaft 11 are shown in FIG. 2.

The drive configuration also shown in FIGS. 4*a*–4*d* runs from the belt pulley 3 over the belt-tightening pulley 4, then over a further belt pulley 5*a* seated on a shaft 35 and back to the belt pulley 3. A gear wheel 33 fastened on the shaft 35 behind the belt pulley 5*a* meshes with a gear wheel 34 fastened on the brake shaft 11, which causes rotation of the gear wheel 11 in the direction of rotation indicated in FIG. 4*a*, for example. If the brake rollers 18 are to rotate in a direction opposite that of the fan discs 2*a*, 2*b* and 2*c*, the drive belt 21 is caused to run from the belt pulley 3 over the belt pulley 5, in which case the belt tightener 6 assumes the position shown in broken lines in FIG. 2. The belt tightener 6 as well as the shaft bearing 12 as shown in FIG. 1, for example, are mounted on the axial beam 14, which is nonmovable. This is used to adjust table 32 height. The tension lever 7 is fastened by two locking screws 26 to the axial beam 14.

In FIG. 3, the construction of the brake rollers is shown in greater detail. Brush segments 19*a* and 19*b* can be fastened onto brake rollers 18, as may also be coverings of elastic guidable material. The thickness of such coverings 28*a*, 28*b* can vary to an extent that a continual braking can be accomplished, as shown in FIG. 3. Besides the structural embodiments of the brake elements shown in FIG. 3, spring or resiliently mounted projections are also conceivable, wherein the yieldability thereof is variable due to a combination of cup springs or helical springs. Furthermore, projections impactable by a damping medium are conceivable, wherein a progressive exertion of brake force is offered. Also, foamed synthetic materials can be used as brake coverings.

FIGS. 4*a*, *b*, *c* and *d* illustrate various phases of operation of the brake rollers and the fan discs during rotation thereof. In view of the straight-edge alignment "A" of the fan blade end 20*c* and the center of the shaft 1, the rotation of the fan can be followed quite readily.

In FIG. 4*a*, the position of the fan blade 20 is designated as "0". A printed product 30 has entered into the fan pocket 22. Its trailing end is disposed adjacent to the trailing end of the leading edge 20*a* of the respective fan blade 20. In this drive configuration, the brush segment 19*a* has moved to the trailing end of the printed product 30 and is about to press the latter against the entrained or simultaneously rotating leading edge 20*a* of the fan blade 20. This movement is reinforced by the movement of the fan blade 20*c* towards the brush segment 19*a*.

Figure 4B:
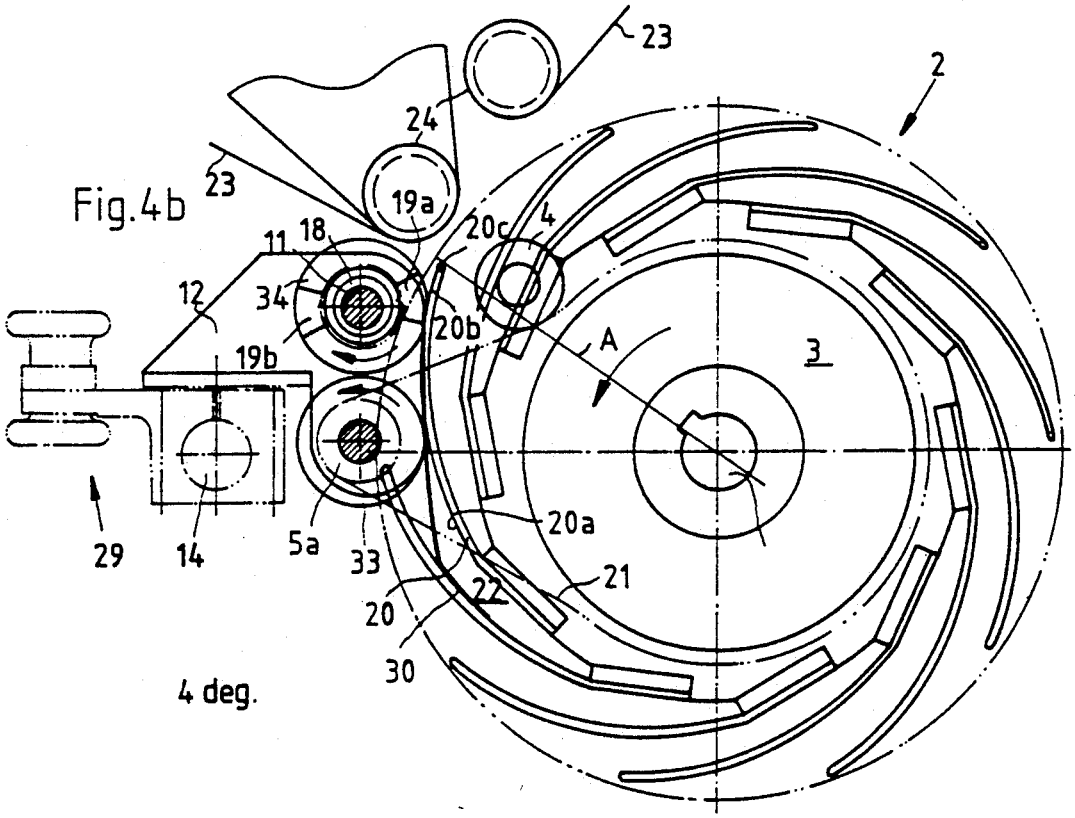

FIG. 4*b* illustrates a phase position of the fan arrangement 2 after the motor shaft 1 has turned through 4°, with respect to the 0° phase position shown in FIG. 4*a*. The printed product 30, at this stage, is gripped by the brush segment 19*a* and pressed against the leading edge 20*a* of the fan blade 20, the highest value of the brake force having not yet been attained, however.

It should be noted that the tightening of the belt is taking place through the belt tightening roller 4 which is in engagement with the drive belt 21 from above the latter, as viewed in FIG. 4*b*.

In the phase shown in FIG. 4*b*, the printed product 30 has entered extensively into the fan pocket 22.

Figure 4C:
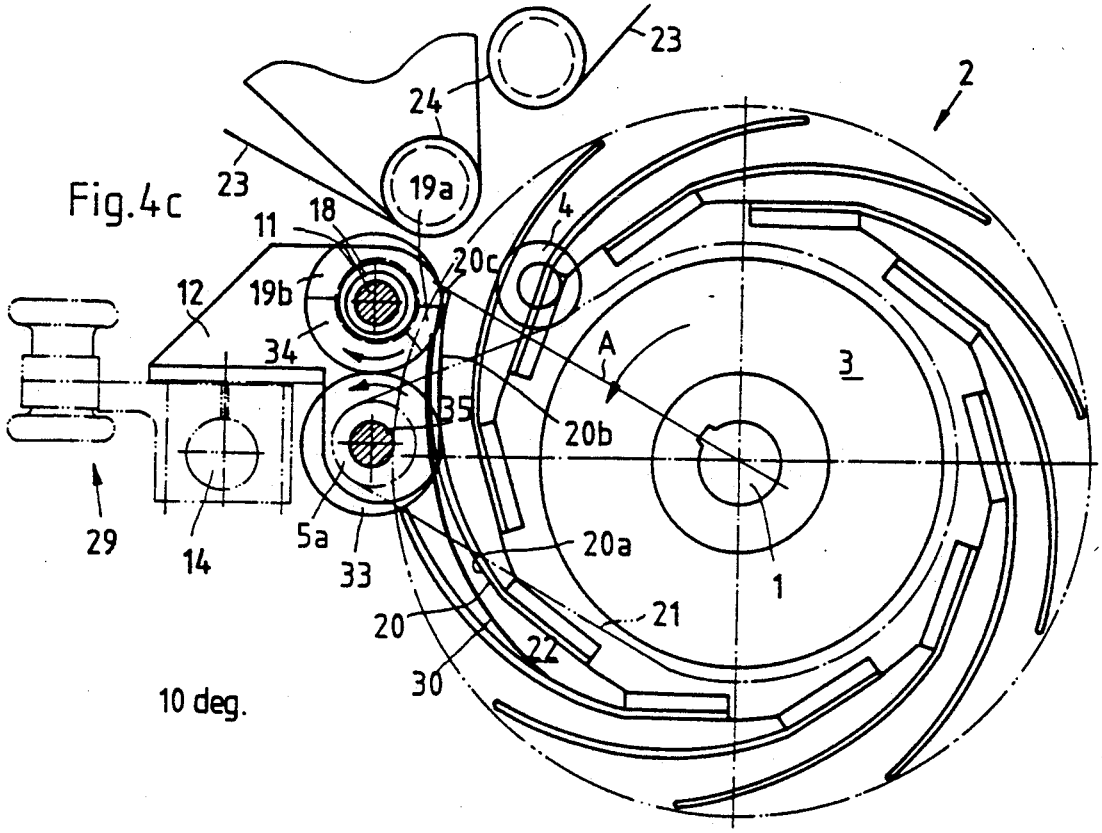

FIG. 4*c* illustrates a phase of operation wherein the fan arrangement 2 has rotated 10° from the position thereof shown in FIG. 4*a*. The brush segment 19*a*, in this rotational phase position, engages the leading edge 20*a* of the fan blade 20. The brushes 19 are experiencing their maximum sweep because the fan blade end 20*c*, during the rotation, has moved towards the brushes and thereby contributes to the increase in the brake force applied.

Figure 4D:
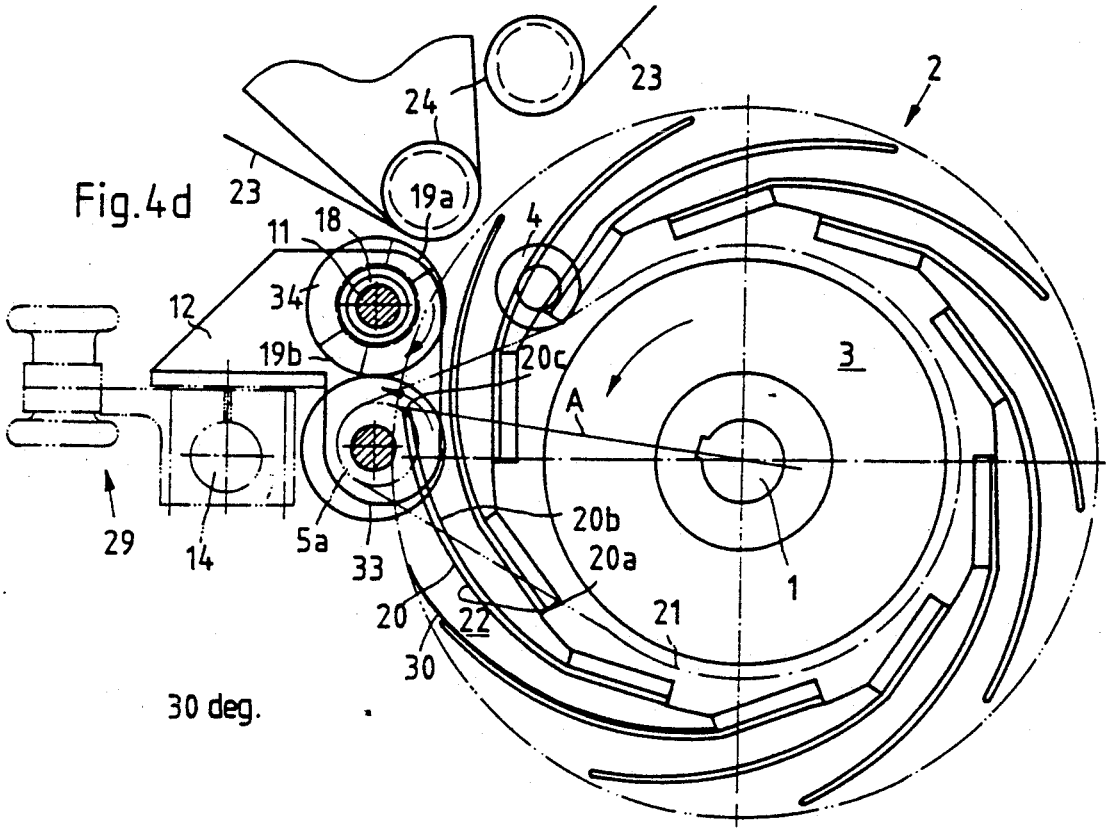

FIG. 4*d* shows the printed product 30 located in the fan pocket 22 after a rotation of 30° by the fan arrangement 2 with respect to the 0° position thereof shown in FIG. 4*a*. The printed product 30, through strippers or the like, is ejected onto a delivery tape 32 (see FIG. 2) disposed below the fan arrangement 2. The delivery tape 32 is pre-tensioned and kept under uniform tension by a tensioning device 31.

What is claimed is:

1. In a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft and corresponding in number to the number of the fan discs, and means for driving said brake shaft via the motor shaft selectively in one of two rotational directions, said brake rollers having means cooperating with leading edges of the fan blades for brakingly engaging and delaying travel of a printed product introduced into the respective fan pockets.

2. Device for braking printed products, according to claim 1, wherein said brakingly engaging means comprise brush segments disposed opposite one another on and fastened to said brake rollers.

3. In a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft and corresponding in number to the number of the fan discs, means for driving said brake shaft via the motor shaft selectively in one of two rotational directions, said brake rollers and leading edges of the fan blades being cooperative for delaying travel of a printed product introduced into the respective fan pockets, and at least one ring mountable on said brake shaft, and elastic coverings applied around the circumference of said one ring, said elastic coverings being disposed opposite one another and having a varying thickness in circumferential direction.

4. In a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft and corresponding in number to the number of the fan discs, means for driving said brake shaft via the motor shaft selectively in one of two rotational directions, said brake rollers and leading edges of the fan blades being cooperative for delaying travel of a printed product introduced into the respective fan pockets, and at least one ring mountable on said brake shaft, and elastic coverings applied to said one ring, said elastic coverings having a friction vale variable over the respective length thereof.

5. In a fan delivery unit of a folder having a plurality of fan discs arranged next to one another on a motor shaft, the fan discs being formed with a plurality of fan blades defining fan pockets therebetween a device for braking printed product, comprising, a driven brake shaft disposed parallel to the motor shaft, a plurality of brake rollers mounted on said brake shaft and corresponding in number to the number of the fan discs, means for driving said brake shaft via the motor shaft selectively in one of two rotational direction, said brake rollers and leading edges of the fan blades being cooperative for delaying travel of a printed product introduced into the respective fan pockets, and an axial beam disposed adjacent said driven brake shaft, means for displaceably mounting shaft bearings for supporting said brake shaft on said axial beam, said mounting means being formed with slots for guiding said displaceable shaft bearings.

6. In a fan delivery unit of a folder having a plurality of an discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft ad corresponding in number to the number of the fan discs, means for driving said brake shaft via the motor shaft selectively in one of two rotational direction, said brake rollers and leading edges of the fan blades being cooperative for delaying travel of a printed product introduced into the respective fan pockets, and bearings supporting said driven brake shaft and a further shaft located adjacent thereto, said brake shaft and said further shaft having a respective belt pulley and a respective gear wheel carried on respective drive-side ends thereof.

7. In a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft and corresponding in number to the number of the fan discs, means for driving sad brake shaft via the motor shaft selectively in one of two rotational directions, said brake rollers and leading edges of the fan blades being cooperative for delaying travel of a printed product introduced into the respective fan pockets, and said means for driving said brake shaft comprising a first belt pulley mounted on the motor shaft, a second belt pulley mounted on said brake shaft, and a drive belt looped about said first and said second belt pulleys for directly driving said brake shaft in a direction of rotation opposite that of the motor shaft.

8. Device for braking printed products according to claim 7, wherein said means for driving said brake shaft includes a belt tightening roller engaging said drive belt for tightening said belt.

9. In a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft and corresponding in number to the number of the fan discs, means for driving said brake shaft via the motor shaft selectively in one of two rotational directions, said brake rollers and leading edges of the fan blades being cooperative for delaying travel of a printed product introduced into the respective fan pockets, said means for driving said brake shaft comprising a belt pulley mounted on the motor shaft, and including a further shaft disposed adjacent said brake shaft, respective meshing gears mounted on said brake shaft and said further shaft, a pulley mounted on said further shaft, and a drive belt looped about said pulley mounted on the motor shaft and said pulley mounted on said further shaft for driving said brake shaft in the same direction of rotation as that of the motor shaft.

10. Device for braking printed products according to claim 9, wherein said means for driving said brake shaft includes a belt tightening roller engaging said drive belt for tightening said belt.

11. In a fan delivery unit of a folder having a plurality of fan discs arranged next to one another on a motor shaft, the fan discs being formed with a plurality of fan blades defining fan pockets therebetween, a device for braking printed products, comprising, a driven brake shaft disposed parallel to the motor shaft, a plurality of brake rollers mounted on said brake shaft and corresponding in number to the number of the fan discs, means for driving said brake shaft via the motor shaft selectively in one of two rotational direction, said brake folders and leading edges of the fan blades being cooperative for delaying travel of a printed product introduced into the respective fan pockets, sad means for driving said brake shaft comprising a first belt pulley mounted on the motor shaft, a second belt pulley mounted on said brake haft, a further shaft disposed adjacent said brake shaft and having a third belt pulley mounted thereon, respective intermeshing gears mounted on said brake shaft and on said further shaft, and a drive belt alternately loopable about one of said second and said third belt pulleys, respectively, and said first belt pulley, for driving said brake shaft in rotational direction, respectively, opposite to and the same as that of the motor shaft.

* * * * *